US006394843B1

(12) United States Patent
Chang et al.

(10) Patent No.: US 6,394,843 B1
(45) Date of Patent: May 28, 2002

(54) CARD CONNECTOR WITH IMPROVED SHELL STRUCTURE

(75) Inventors: Jen Jou Chang, Yung-Ho; Hugh Chi Hsu, Tu-Chen, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/911,944

(22) Filed: Jul. 23, 2001

(30) Foreign Application Priority Data

Jun. 13, 2001 (TW) ..... 90209865 U

(51) Int. Cl.[7] ..... H01R 13/635
(52) U.S. Cl. ..... 439/607; 439/159
(58) Field of Search ..... 439/607, 541.5, 439/108, 79, 64, 152, 159, 160, 267, 630, 608–610

(56) References Cited

U.S. PATENT DOCUMENTS 5,421,737 A * 6/1995 Chen et al. ..... 439/157
6,102,723 A * 8/2000 Kusakabe et al. ..... 439/267
6,193,547 B1 * 2/2001 Tung ..... 439/541.5

* cited by examiner

*Primary Examiner*—Brian Sircus
*Assistant Examiner*—Son V. Nguyen
(74) *Attorney, Agent, or Firm*—Wei Te Chung

(57) ABSTRACT

A card connector (1) has a U-shaped insulative frame (20), a number of terminals (40), a top metal shell (10) and a bottom metal shell (30). The frame has a transverse base (21) and two perpendicular arms (22, 23). The terminals are retained in the base. The top shell has a plurality of locking holes (17) and the bottom shell has a plurality of locking elements (37) corresponding to the locking holes. The locking holes and the locking elements engage with each other, thus the top shell and the bottom shell interlock each other and enclose the frame therein. A card-receiving space (29) is defined between the shells. In use, the card connector can be embedded in a cutout (21) of a printed circuit board (2) for a smaller thickness thereabove.

12 Claims, 7 Drawing Sheets

CARD CONNECTOR WITH IMPROVED SHELL STRUCTURE

FIELD OF THE INVENTION

The present invention generally relates to a card connector, and more particularly to a card connector interconnecting an electrical card with a printed circuit board (PCB).

BACKGROUND OF THE INVENTION

Electrical cards are widely used in electrical devices for storing information. Generally, a card connector is used for interconnecting the electrical card with an electrical device. A related conventional card connector is disclosed in Japanese Patent Application Publication No. 11066247. The card connector includes a housing and a plurality of terminals received in the housing. In use, the card connector is mounted on a printed circuit board (PCB) surface and a card-receiving space is formed between the PCB surface and a top cover of the housing.

However, with the trend of reducing the height of electrical card, the thickness of the conventional connector needs to be reduced by reducing thickness of the housing. Thus, it will not only add difficulty to manufacture the housing, but also weaken the overall strength of the connector. With the card being inserted or withdrawn repeatedly, the forces exerted on the housing will easily bend or break the housing. In addition, the card connector of the prior art is mounted on the PCB surface, thus the height of the connector above the PCB is too high.

Hence, a reliable and easily made card connector structure is needed to overcome the foregoing problems.

BRIEF SUMMARY OF THE INVENTION

A main object of the present invention is to provide a card connector with reliable strength.

Another object of the present invention is to provide a card connector with simple structure and low profile.

The card connector according to the present invention includes an U-shaped insulative frame, a plurality of terminals retained in the frame, a top metal shell and a bottom metal shell interlocking with each other and enclosing the frame therebetween. The frame includes a transverse base and two perpendicular arms extending from opposing ends of the base. The terminals are retained in the base. The top shell comprises a top wall and a pair of intermittent sidewalls downwardly depending from opposing edges of the top wall. A plurality of locking holes is defined along the sidewalls of the top wall. The bottom shell comprises a bottom wall, a back wall and a pair of intermittent sidewalls upwardly extending from opposing edges of the bottom wall. A plurality of locking elements is formed along the sidewalls of the bottom shell corresponding to the locking holes. A card-receiving space is defined between the top shell and the bottom shell for receiving an electrical card therein. The metal shells structure is durable against forces exerted on the card connector, and it is easy to manufacture. In use, the card connector according to the present invention can be embedded in a cutout of a PCB, thus it will reduce the overall thickness above the PCB apparently.

Other objects, advantages and novel feather of the invention will become more apparent from the following detailed description when taken in conjunction with the accompanying drawings.

DETAILED DESCRIPTION OF THE INVENTION

Figure 1:
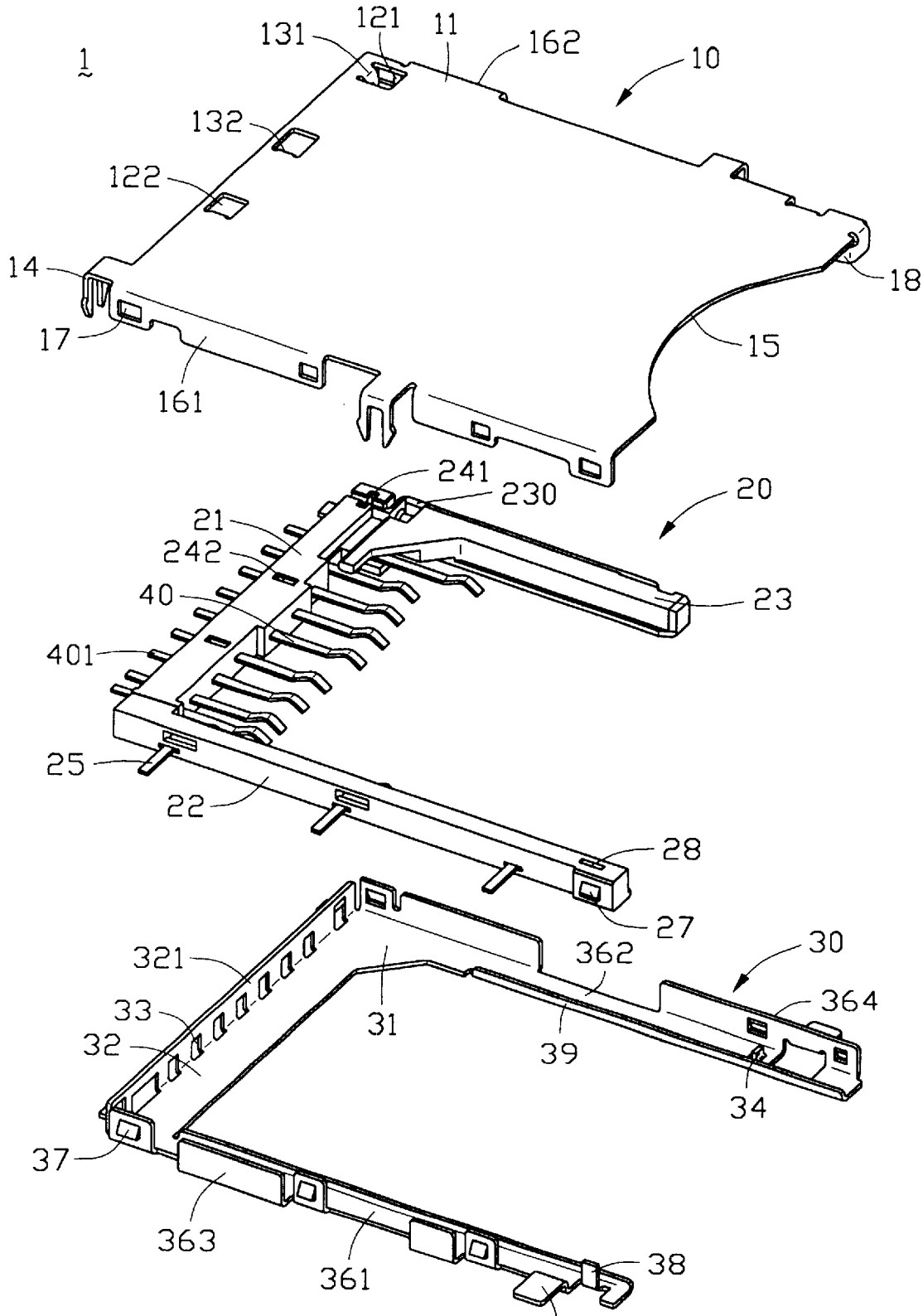
FIG. 1 is an exploded view of a card connector according to the present invention.
Figure 2:
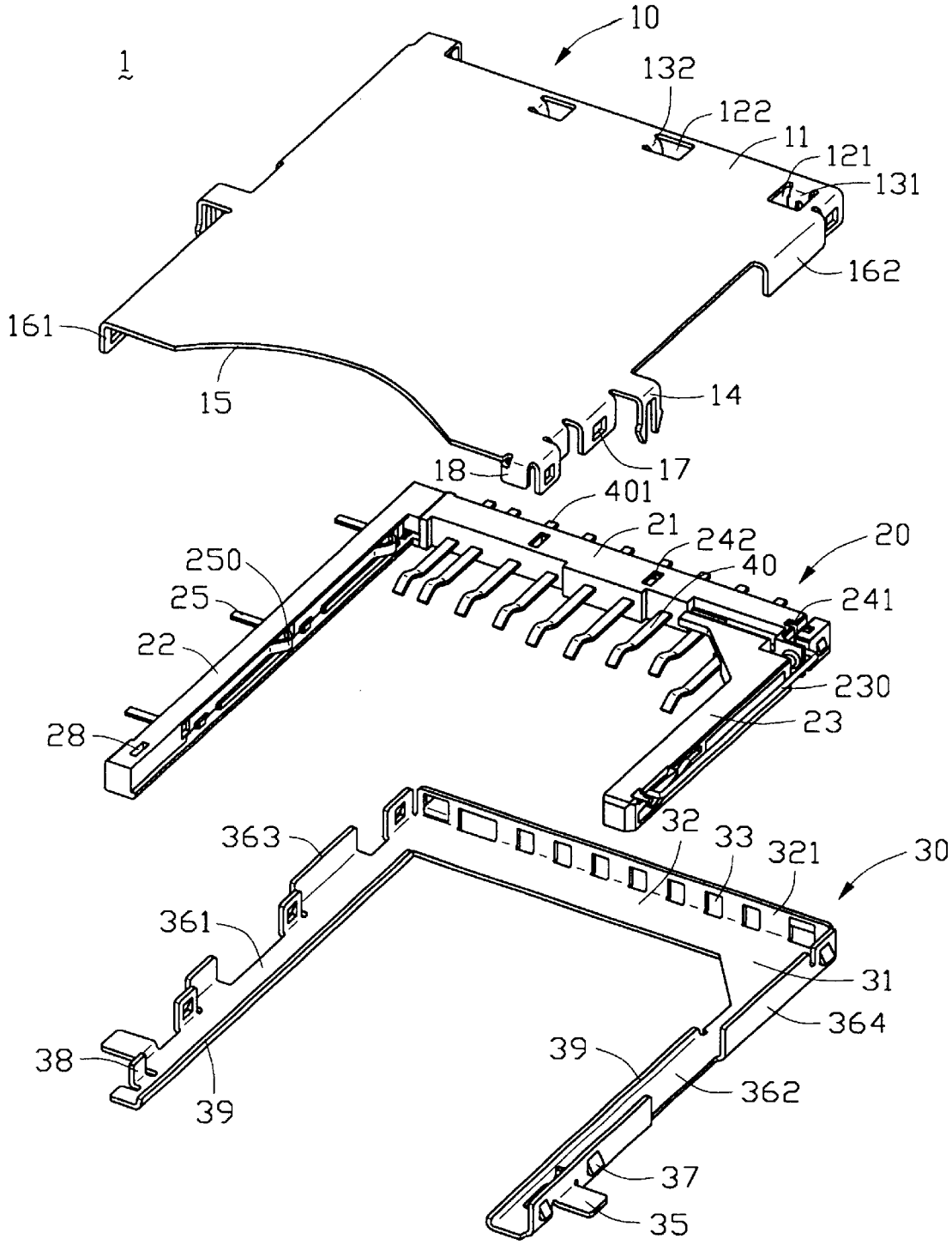
FIG. 2 is similar to FIG. 1, but taken from another angle of view.

Referring to FIGS. 1–2, a card connector 1 according to the present invention includes a U-shaped insulative frame 20, a top metal shell 10, a bottom metal shell 30, and a plurality of terminals 40.

The frame 20 comprises a transverse base 21 and two arms 22, 23 extending perpendicularly from opposing ends thereof. The base 21 defines a plurality of passageways (not labeled) to receive the terminals 40. A side slot 241 and two middle slots 242 downwardly extend through the base 21.

The mounting arm 22 is longer than the ejecting arm 23. A plurality of switch contacts 250 is retained in the mounting arm 22 with their solder ends 25 outwardly extending from outer surface of the mounting arm 22. In addition, a front slot 28 is downwardly defined through in the mounting arm 22. A locking member 27 is formed on outside surface of front end of the mounting arm 22. An ejector 230 is slidably mounted in outside edge of the ejecting arm 23, thus forms a conventional ejecting mechanism.

The rectangular top shell 10 includes a top wall 11 and two intermittent sidewalls 161, 162 downwardly depending from opposing edges of the top wall 11. One side opening 121 and two middle openings 122 are defined at a rear edge of the top wall 11. In addition, one side tab 131 and two middle tabs 132 downwardly depend from edges of the side opening 121 and the middle openings 122 respectively corresponding to the side slot 241 and the middle slots 242 in the frame 20. The top wall 11 further defines an arcuate portion 15 at its front end.

A plurality of locking holes 17 are defined in the first sidewall 161 and the second sidewall 162. Three board locks 14 respectively downwardly depend from edges of the top wall 11 except the edge of the arcuate portion 15. A L-shaped guide 18 downwardly depends from front edge of the top wall 11 and inwardly extends from its front surface parallel to the second sidewall 162.

The U-shaped bottom shell 30 comprises a bottom wall 31, a back wall 321 and a pair of intermittent sidewalls 363, 364. The bottom wall 31 includes a transverse body 32 and two perpendicularly arms 361, 362 extending from opposing ends thereof. The back wall 321 upwardly extends from back edge of the body 32. A plurality of through holes 33 is defined in the back wall 321 corresponding to the solder portions 401 of the terminals 40 retained in the frame 20.

The intermittent mounting sidewall 363 and the intermittent ejecting sidewall 364 respectively upwardly extends from outer side edges of the first arm 361 and the second arm 362. A pair of elongate flanges 39 upwardly project from inner edges of the two parallel arms 361, 362. A plurality of locking elements 37 is formed on the mounting sidewall 363 and the ejecting sidewall 364 corresponding to the locking holes 17 in the top shell 10. A plurality of solder pads 35 is formed on peripheral edges of the bottom wall.31 for soldering onto a PCB. A front tab 38 is formed in front end of the first arm 361 corresponding to the front slot 28 in the frame 20. A positioning tab 34 upwardly projects from proximate front end of the second arm 362 corresponding to inner end of the guide 18 of the top shell 10.

Figure 3:
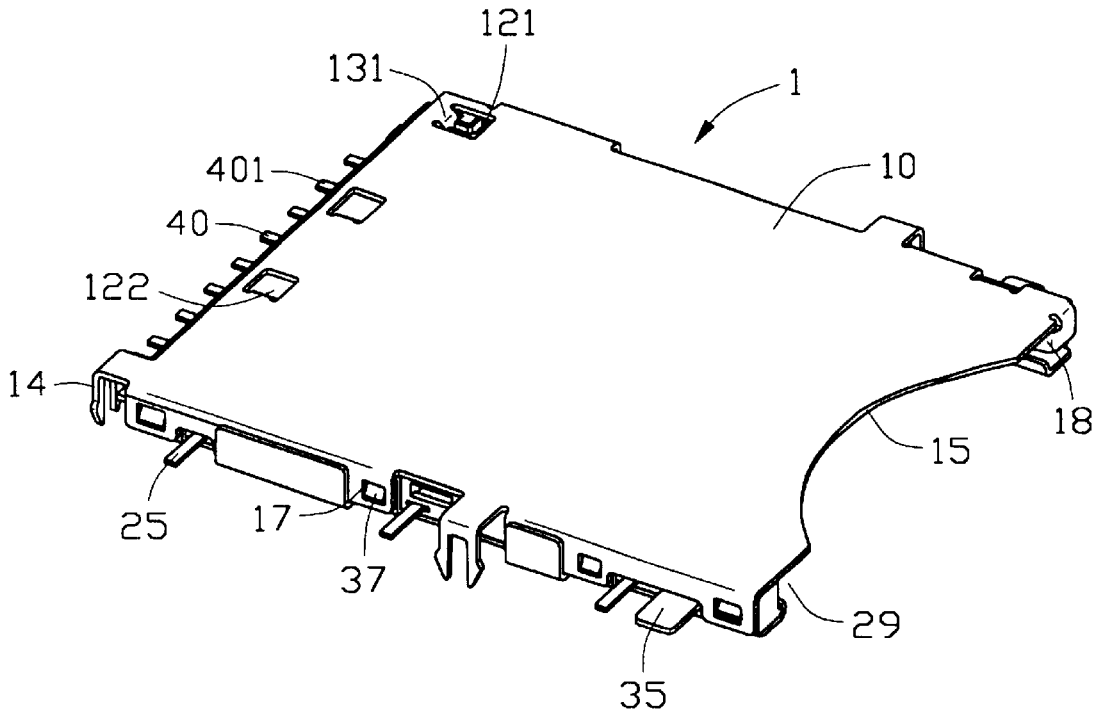
FIG. 3 is an assembled view of FIG. 1.
Figure 4:
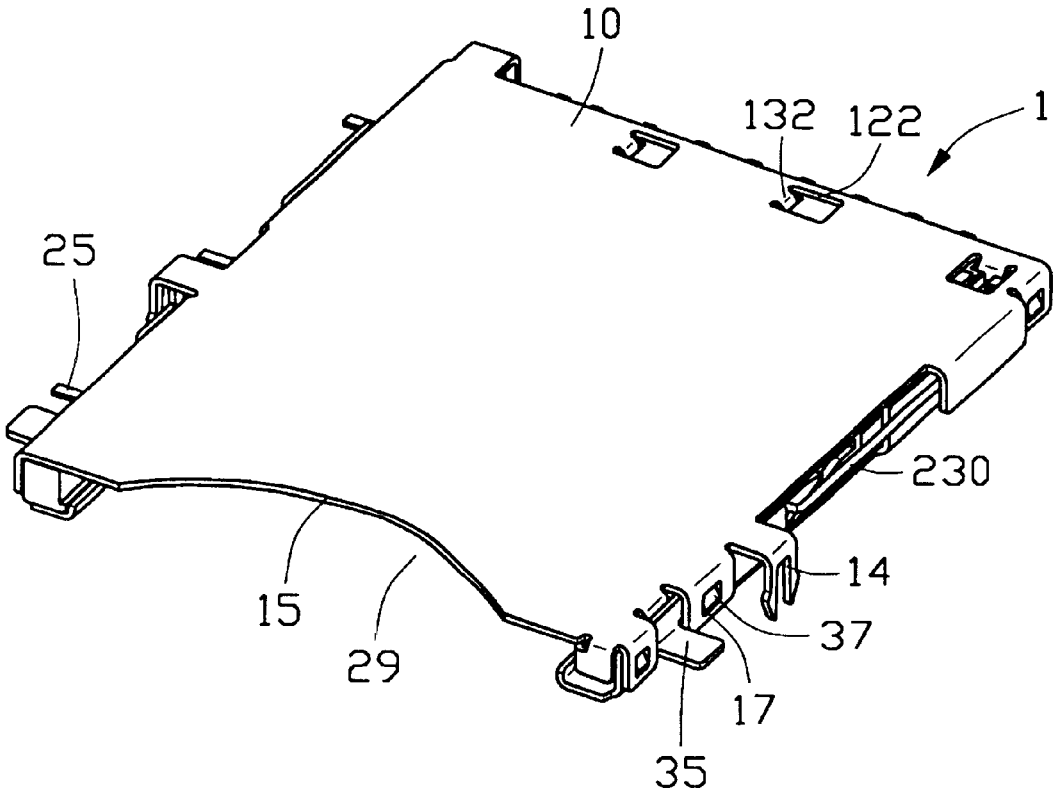
FIG. 4 is an assembled view of FIG. 2.

Referring to FIGS. 3–4, in assembly, the U-shaped frame 20 is mounted on the U-shaped bottom shell 30. The base 21 is supported on the body 32 with the solder portions 401 of the terminals 40 extending through the through holes 33. The mounting arm 22 of the frame 20 is mounted on the first arm 361 of the bottom shell 30. The front tab 38 is fitted in the front slot 28 thereby securing the frame 20 to the bottom shell 30. At the same time, the ejecting arm 23 is mounted on the second arm 362.

Then, the top shell 10 is interlocked with the bottom shell 30 to enclose the frame 20 tightly therebetween. The middle tabs 132 and the side tab 131 of the top shell 10 are respectively fitted in the middle slots 242 and the side slot 241 of the frame 20. The locking holes 17 in the sidewalls 161, 162 of the top shell 10 are respectively engaged with the locking elements 37 of the bottom shell 30 and the locking member 27 of the frame 20. The guide 18 of the top shell 10 is retained on the second arm 362 of the bottom shell 30 with its inner end abutting the positioning tab 34. A card-receiving space 29 is defined between the interlocked shells. Thus, the card connector 1 with reliable strength and simple structure is available.

Figure 5:
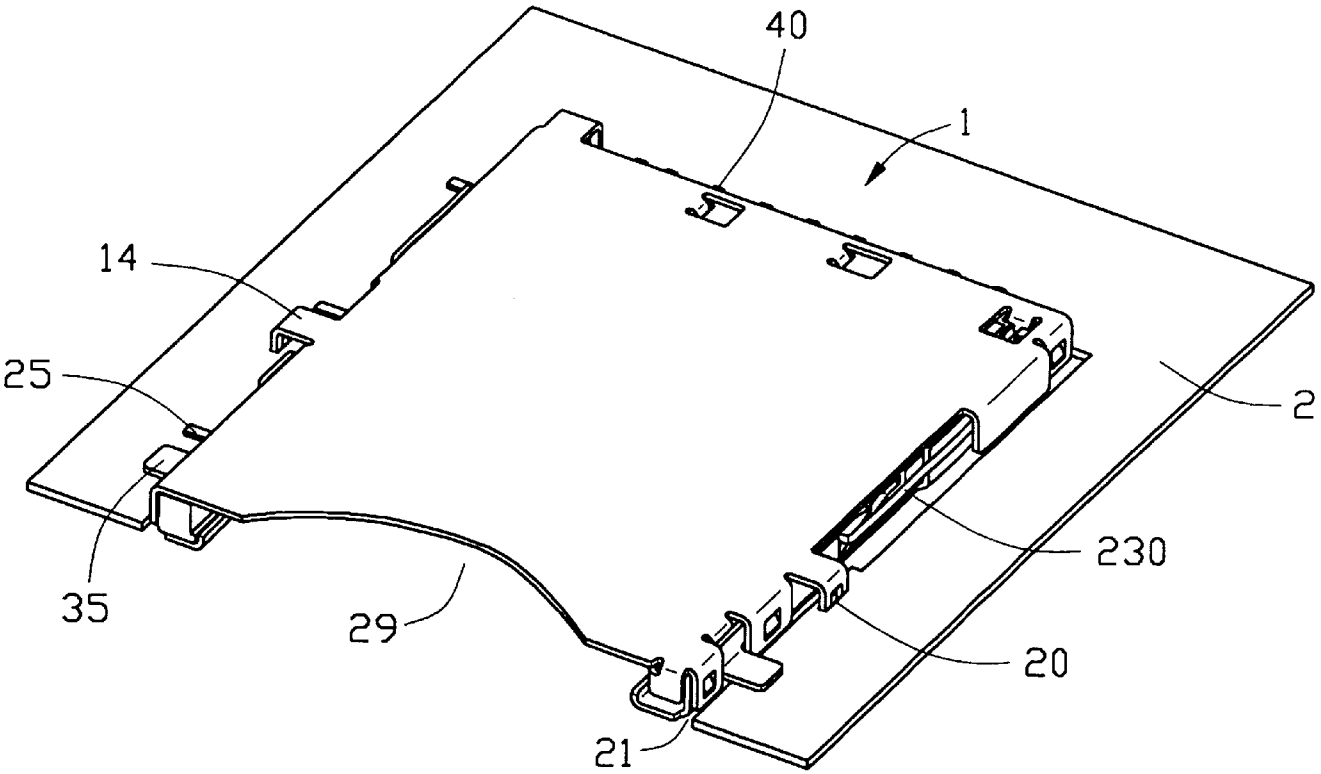
FIG. 5 is an assembled view showing an application of the card connector according to the present invention wherein the card connector is embedded in a cutout of a PCB.
Figure 6:
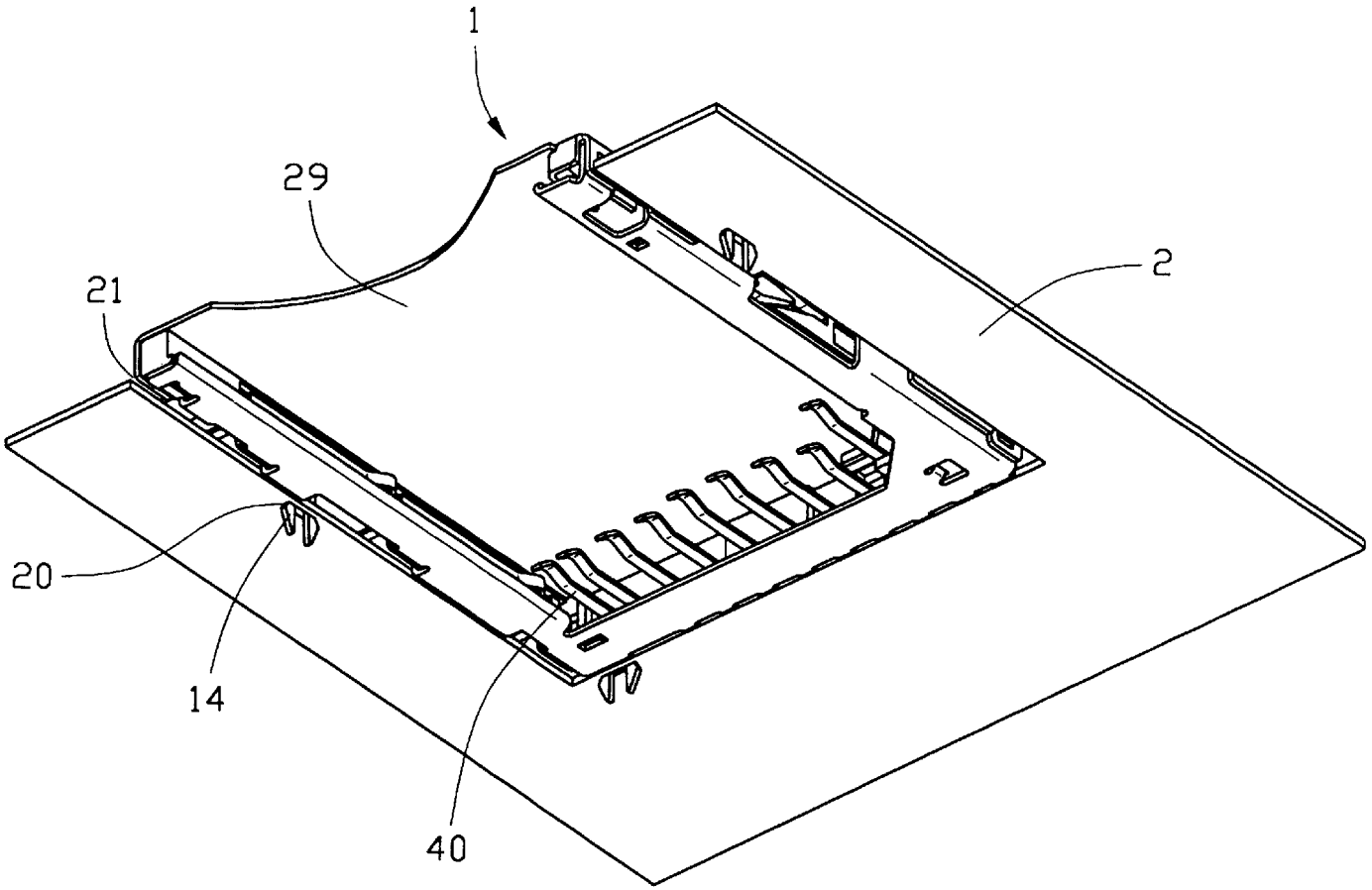
FIG. 6 is similar to FIG. 5, but taken from another angle of view.

Referring to FIGS. 5–6, the card connector 1 according to the present invention is embedded in a cutout 21 of a PCB 2. The size of the rectangular cutout 21 is proximate equal to the size of the card connector 1. The board locks 14 of the top shell 10 are respectively engaged with a plurality of engaging holes 20 in the PCB 2. The solder pads 35 of the bottom shell 30, the solder ends 25 and the solder portions 401 of the terminals 40 are respectively soldered to the traces (not shown) on the PCB 2. The solder pads 35, the solder ends 25 and the solder portions 401 of the terminals 40 all are located above the bottom wall 31, thus a smaller thickness of the card connector 1 above the PCB 2 is achieved.

Figure 7:
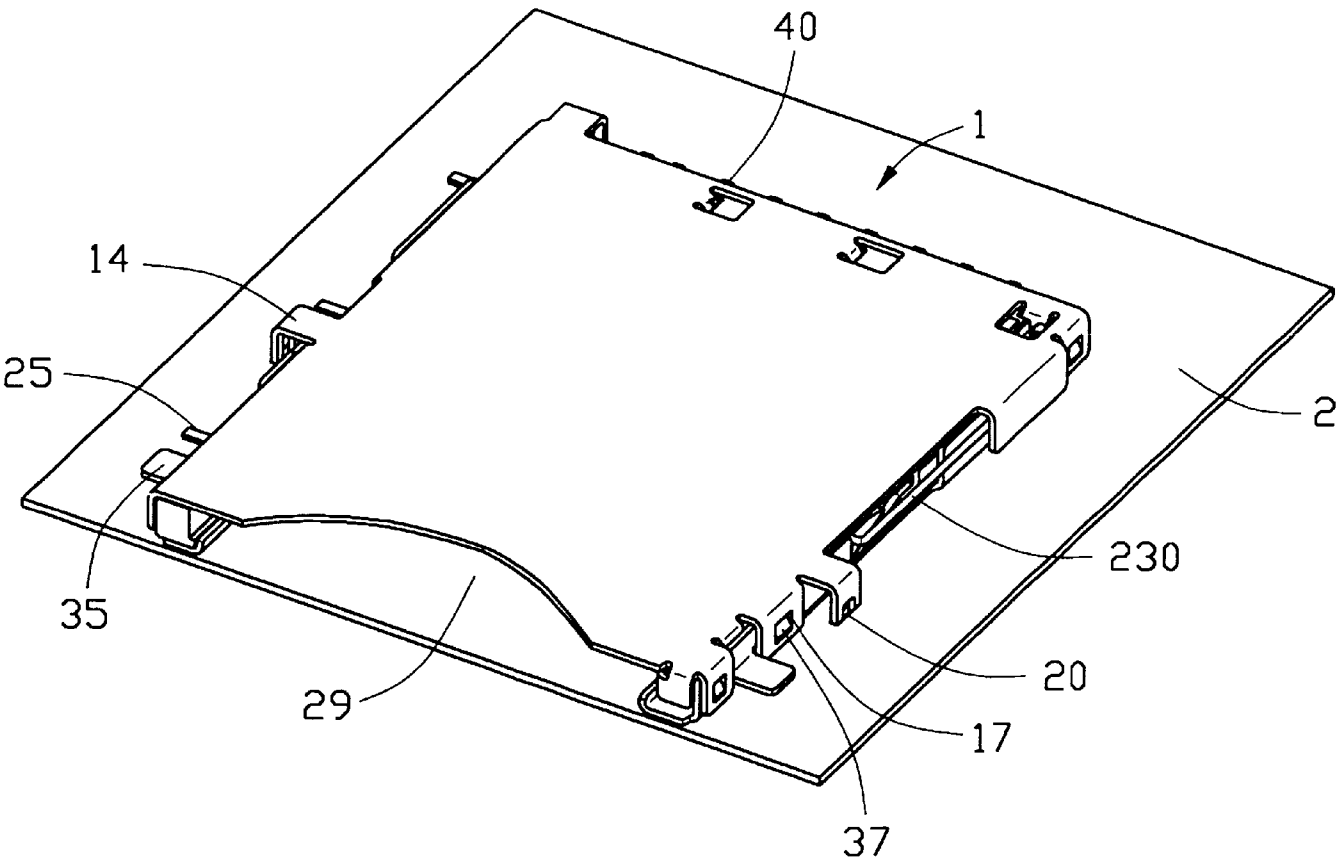
FIG. 7 is an assembled view showing another application of the card connector according to the present invention wherein the card connector is mounted on a surface of a PCB.

Referring to FIG. 7, according to another embodiment of the present invention, the card connector I is mounted on a surface of a PCB 2. The solder pads 35, the solder ends 25 and the solder portions 401 all locate at the same horizontal plane with the bottom wall 31.

In use, an electrical card (not shown) can be inserted into or withdrawn from the card-receiving space 29. The card can slide on the flanges 39 of the bottom shell 30 and can be restricted by the guide 18 inhorizontal direction for avoiding swinging.

It is to be understood, however, that even though numerous, characteristics and advantages of the present invention have been set forth in the foregoing description, together with details of the structure and function of the invention, the disclosed is illustrative only, and changes may be make in detail, especially in matters of shape, size, and arrangement of parts within the principles of the invention to the full extent indicated by the broad general meaning of the terms in which the appended claims are expressed.

What is claimed is:

1. A card connector for interconnecting a card and a printed circuit board (PCB), comprising:

a U-shaped insulative frame including a transverse base, a mounting arm and an ejecting arm, the mounting arm and the ejecting arm perpendicularly extending from opposing ends of the base;

a plurality of terminals retained in the base;

a bottom shell including a U-shaped bottom wall, a back wall, an intermittent mounting sidewall and an intermittent ejecting sidewall upwardly extending from peripheral edges of the bottom wall, each of said mounting sidewall and said ejecting sidewall forms a plurality of locking elements; and a top shell including a top wall, a first intermittent sidewall and a second intermittent sidewall, the first and second sidewalls downwardly extending from opposing edges of the top wall, each of said first and second sidewalls defines a plurality of locking holes interlocked to said locking elements in said bottom shell, the top and bottom shells enclose the frame and define a card-receiving space therebetween; wherein said back wall defines a plurality of through holes for solder portions of said terminals to extend therethrough; wherein said bottom wall includes a transverse body, a first arm and a second arm, the first and the second arms perpendicularly extend from opposing ends of the body, and said base, said mounting arm and said ejecting arm of the frame are respectively mounted on the body, the first arm and the second arm of the bottom wall; wherein said top shell includes a guide for limiting a horizontal swing of said card, the guide downwardly extending from a front end of said top shell and inwardly extending from its front surface parallel to said second sidewall.

2. The card connector according to claim 1, wherein said base of said frame defines a plurality of slots therethrough, and said top wall forms a plurality of tabs corresponding to said slots.

3. The card connector according to claim 1, wherein said mounting arm of said frame defines at least one slot therethrough, and said first arm forms at least a tab corresponding to the at least one slot.

4. The card connector according to claim 1, wherein said top shell includes a plurality of board locks for engaging with corresponding engaging holes in the PCB.

5. The card connector according to claim 1, wherein said bottom shell includes a plurality of solder pads for being soldered to corresponding traces on the PCB.

6. The card connector according to claim 1, wherein said bottom shell includes a positioning tab upwardly projecting from said bottom wall and abutting an inner end of said guide.

7. The card connector according to claim 1, wherein said top shell includes an arcuate portion formed at a front end of the top shell.

8. The card connector according to claim 1, wherein said bottom shell includes a pair of parallel flanges upwardly projecting from inner edges of said first arm and said second arm.

9. The card connector according to claim 1, wherein said frame includes a locking member formed on said mounting arm for interlocking with one of said locking holes in said top shell.

10. The card connector according to claim 1, wherein a plurality of switch contacts is retained in the mounting arm with solder ends thereof outwardly extending from an outer surface of said mounting arm.

11. A card connector assembly comprising:

a card connector including a frame, a plurality of terminals having solder portions extending from said frame, a top metal shell and a bottom metal shell interlocking with each other and enclosing said frame therebetween, said top metal shell including a plurality of board locks and said bottom metal shell including a plurality of solder pads, said frame retaining a plurality of switch contacts with solder ends, the solder portions of said terminals, the solder ends and the solder pads all being located above a bottom surface of said bottom metal shell; and a PCB including a cutout in which said card connector is embedded, a plurality of engaging holes with which said board locks are engaged, and a plurality of traces on which said terminals and said solder pads are soldered; wherein a back wall of said bottom metal shell defines a plurality of through holes for solder portions of said terminals to extend therethrough; wherein a bottom metal wall of said bottom metal shell includes a transverse body, a first arm and a second arm, the first and the second arms perpendicularly extend from opposing ends of the body, and said frame includes a base, a mounting arm and an ejecting arm respectively mounted on the body, the first arm and the second arm of the bottom metal wall; wherein said top metal shell includes a guide for limiting a horizontal swing of a card, the guide downwardly extending from a front end of said top metal shell and inwardly extending from its front surface parallel to said second sidewall.

12. A card connector assembly comprising:

a card connector including a frame, a plurality of terminals having solder portions extending from said frame, a top metal shell and a bottom metal shell interlocking with each other and enclosing said frame therebetween, said top metal shell including a plurality of board locks and said bottom metal shell including a plurality of solder pads, said frame retaining a plurality of switch contacts with solder ends, the solder portions of said terminals, the solder ends and the solder pads all being located leveling with a bottom surface of said bottom metal shell; and a PCB on which said card connector is soldered including a plurality of engaging holes with which said board locks are engaged, and a plurality of traces on which said terminals and said solder pads are soldered; wherein a back wall of said bottom metal shell defines a plurality of through holes for solder portions of said terminals to extend therethrough; wherein a bottom metal wall of said bottom metal shell includes a transverse body, a first arm and a second arm, the first and the second arms perpendicularly extend from opposing ends of the body, and said frame includes a base, a mounting arm and an ejecting arm respectively mounted on the body, the first arm and the second arm of the bottom metal wall; wherein said top metal shell includes a guide for limiting a horizontal swing of a card, the guide downwardly extending from a front end of said top metal shell and inwardly extending from its front surface parallel to said second sidewall.

* * * * *